US011059614B2

(12) United States Patent
Granger et al.

(10) Patent No.: US 11,059,614 B2
(45) Date of Patent: Jul. 13, 2021

(54) INSULATION PACKAGING SYSTEM

(71) Applicants: Mark Alan Granger, Highlands Ranch, CO (US); Bradley Ray Lockwood, Highlands Ranch, CO (US)

(72) Inventors: Mark Alan Granger, Highlands Ranch, CO (US); Bradley Ray Lockwood, Highlands Ranch, CO (US)

(73) Assignee: Johns Manville, Denver, CO (US)

( * ) Notice: Subject to any disclaimer, the term of this patent is extended or adjusted under 35 U.S.C. 154(b) by 110 days.

(21) Appl. No.: 16/039,662

(22) Filed: Jul. 19, 2018

(65) Prior Publication Data

US 2020/0024017 A1 Jan. 23, 2020

Related U.S. Application Data

(62) Division of application No. 15/249,862, filed on Aug. 29, 2016, now Pat. No. 10,112,757.

(51) Int. Cl.

| | |
|---|---|
| ***B65B 27/12*** | (2006.01) |
| ***B65B 5/06*** | (2006.01) |
| ***B65B 63/02*** | (2006.01) |
| ***B65B 11/02*** | (2006.01) |
| ***B65B 11/58*** | (2006.01) |

(52) U.S. Cl.

CPC ..... *B65B 27/125* (2013.01); *B65B 5/067* (2013.01); *B65B 11/02* (2013.01); *B65B 11/58* (2013.01); *B65B 63/02* (2013.01)

(58) Field of Classification Search

CPC ..... B65D 27/125; B65D 5/06; B65D 5/067; B65D 11/02; B65D 11/58; B65D 63/02; B65D 71/063; B65D 85/07; B65D 65/02; B65D 71/08; B65D 75/006

USPC ..... 53/438, 529, 449, 528

See application file for complete search history.

(56) References Cited

U.S. PATENT DOCUMENTS

| | | | | |
|---|---|---|---|---|
| 2,141,488 | A | 12/1938 | Riedel | |
| 3,999,357 | A * | 12/1976 | Marantz | B65B 11/585 53/442 |
| 4,555,017 | A | 11/1985 | Blackmore | |
| 5,129,211 | A * | 7/1992 | Andersson | B65B 9/026 53/399 |
| 5,350,063 | A | 9/1994 | Berdan, II | |
| 5,392,912 | A * | 2/1995 | Grubbs | B65D 71/10 206/451 |
| 5,632,558 | A | 5/1997 | Baker | |
| 5,862,650 | A | 1/1999 | Adams et al. | |
| 5,902,684 | A * | 5/1999 | Bullard | B32B 27/32 428/515 |
| 5,907,942 | A * | 6/1999 | Eichbauer | B32B 27/32 53/441 |
| 6,021,890 | A * | 2/2000 | Focke | B65B 11/58 206/391 |

(Continued)

*Primary Examiner* — Dariush Seif

(74) *Attorney, Agent, or Firm* — Robert D. Touslee

(57) ABSTRACT

The present disclosure is directed to an insulation packaging system. The insulation packaging system includes a plurality of insulation packages with first ends and second ends. The plurality of insulation packages defining an axis. A first film wraps around the axis to compress and couple the plurality of insulation packages together, while a second film wraps around the first and second ends of the plurality of insulation packages. The first and second films are different films.

13 Claims, 4 Drawing Sheets

(56) References Cited

U.S. PATENT DOCUMENTS

| | | | | |
|---|---|---|---|---|
| 6,471,061 | B1 * | 10/2002 | Teague | B65D 71/0088 206/442 |
| 7,041,353 | B2 | 5/2006 | Smith et al. | |
| 7,311,199 | B2 * | 12/2007 | Vantilt | B65D 75/38 206/321 |
| 7,827,766 | B2 * | 11/2010 | Matsumoto | B65B 11/025 53/439 |
| 9,708,085 | B2 * | 7/2017 | Moore | B65B 27/125 |
| 2003/0116462 | A1 | 6/2003 | Sorebo et al. | |
| 2007/0122600 | A1 * | 5/2007 | Yoshino | C08J 5/18 428/220 |
| 2009/0173048 | A1 * | 7/2009 | Yadav | B65B 25/20 53/510 |
| 2011/0041460 | A1 * | 2/2011 | Weisinger | B32B 27/08 53/441 |
| 2013/0067861 | A1 * | 3/2013 | Turner | B65D 75/006 53/428 |
| 2013/0287323 | A1 * | 10/2013 | Slovut | B65D 71/08 383/84 |
| 2015/0051314 | A1 * | 2/2015 | Cho | C08K 5/0008 523/220 |
| 2015/0203221 | A1 * | 7/2015 | Van De Hey | B65B 63/02 206/446 |
| 2015/0232221 | A1 * | 8/2015 | Jacobs | B65D 75/002 428/35.2 |
| 2015/0258754 | A1 * | 9/2015 | Schulz | B32B 7/02 428/516 |
| 2016/0353943 | A1 * | 12/2016 | Overley | B65D 85/02 |
| 2018/0105298 | A1 * | 4/2018 | Frenzel | B65B 53/02 |
| 2018/0362233 | A1 * | 12/2018 | Christensen | B65D 71/063 |

* cited by examiner

INSULATION PACKAGING SYSTEM

CROSS REFERENCE TO RELATED APPLICATIONS

This application is a Division of pending U.S. application Ser. No. 15/249,862 filed Aug. 29, 2016. The entire contents of the above-identified application is incorporated by reference for all purposes.

FIELD OF THE INVENTION

The disclosure generally relates to a packaging system.

BACKGROUND OF THE INVENTION

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Insulation is typically bundled into units that contain multiple insulation packages. During the bundling process, the insulation packages are compressed together to reduce space for shipping and storage. Once compressed, bands or film is wrapped around the packages to keep the packages together and in a compressed state. The insulation packages may then be shipped and/or stored as units for later use. However, during shipping and handling the bands may tear through the exterior wrapping of the insulation packages exposing the insulation to rain, snow, dirt, etc. Furthermore, films may tear during shipping and handling, which can release insulation packages from their compressed state as well as scatter them.

SUMMARY OF THE INVENTION

The present disclosure is directed to an insulation packaging system. The insulation packaging system includes a plurality of insulation packages with first ends and second ends. The plurality of insulation packages defining an axis. A first film wraps around the axis to compress and couple the plurality of insulation packages together, while a second film wraps around the first and second ends of the plurality of insulation packages. The first and second films are different films.

An aspect of the disclosure includes a method of packaging insulation. The method includes compressing a plurality of insulation packages together. The plurality of insulation packages include first ends and second ends, as well as define an axis. The method then wraps a first film around the axis to couple the plurality of insulation packages together. After wrapping the insulation packages in the first film, a second film is wrapped around the first and second ends of the plurality of insulation packages.

Another aspect of the disclosure includes a method of packaging insulation. The method includes compressing a plurality of insulation packages together. The plurality of insulation packages include first ends and second ends, as well as define an axis. The method then inserts the plurality of insulation packages into a bag formed from a first film. After inserting the insulation packages into the bag, a second film is wrapped around the first and second ends of the plurality of insulation packages.

BRIEF DESCRIPTION OF THE DRAWINGS

Various features, aspects, and advantages of the present invention will be better understood when the following detailed description is read with reference to the accompanying figures in which like characters represent like parts throughout the figures, wherein.

DETAILED DESCRIPTION

One or more specific embodiments of the present invention will be described below. These embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The embodiments discussed below include an insulation packaging system that compresses and couples a plurality of insulation packages together into a unit. The insulation packaging system includes first and second films that wrap around the insulation packages. Together the first and second films may protect all exposed surfaces of the insulation packages from rain, snow, dirt, etc. As will be explained below, the first and second films have different properties that complement each other. For example, the first film may compress and couple the insulation packages together, while the second film protects and supplements the compressive force of the first film. In some embodiments, the second film may also facilitate movement and storage of the unit. For example, the second film may include corded or roped portions that enable users to grab and manipulate the unit (e.g., during shipment, during warehouse operations, on a worksite). The second film may also have a coefficient of friction that facilitates stacking of the units for shipping and warehousing operations.

Figure 1:
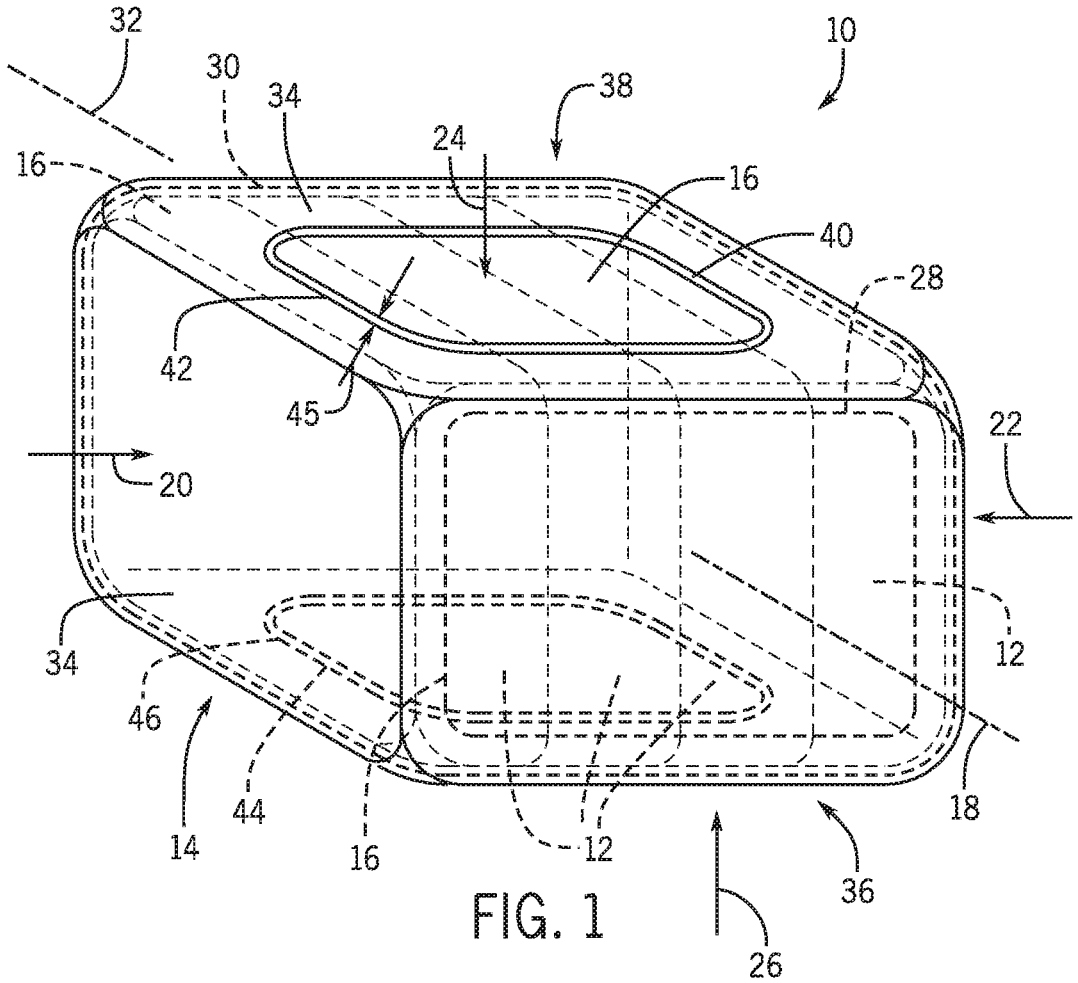
FIG. 1 is a perspective view of an insulation packing system that couples multiple insulation packages into a unit.

FIG. 1 is a perspective view of an insulation packaging system 10 that couples multiple insulation packages 12 into a unit 14. For example, the insulation packaging system 10 may wrap around 1, 2, 3, 4, 5, 6, 7, 8, 9, 10 or more insulation packages 12. The insulation packages 12 may include insulation in the form of batts, rolls, boards etc. and may have pre-compression dimensions between 30" and 120". The insulation packing system 10 couples and compresses the insulation packages 12 together by wrapping around an axis 18, formed by the insulation packages 12. For example, the first film 16 provides a compressive force in axial directions 20, 22, 24, and 26. By compressing the insulation packages 12, the first film 16 saves space and facilitates transportation and storage of the units 14. In some embodiments, compressing the insulation packages 12 may reduce the size of the insulation packages by 150 percent or more. In order to block expansion of the insulation packages 12, the first film 16 may be a machine direction orientation (MDO) film made out of polypropylene, single layer polyethylene, reinforced polyethylene, etc. that stretches little or not at all in response to force from the compressed insulation packages 12.

MDO film is a film that has been plastically pre-stretched in an axial direction to 70%, 80%, 90% or more of the material yield strength. Accordingly, the first film 16 may stretch less than 10%, 5%, 3%, 2%, or 1% in response to the force from the insulation packages 12. However, the first film 16 may not have sufficient strength to resist forces (e.g., tensile) acting on its opposing first film ends 28 and 30. For example, forces acting on the first film ends 28, 30 in axial directions 18 and 32 may plastically deform and even tear the first film 16. If torn, the first film 16 may prematurely release the insulation packages 12 from their compressed state and enable the insulation packages 12 to uncouple and scatter.

In order to shield the first film ends 28, 30 from forces in axial directions 18 and 32, the insulation packaging system 10 includes a second film 34. As illustrated, the second film 34 wraps around the insulation packages 12 and the first film ends 28, 30. In this way, the second film 34 protects the first film ends 28, 30 of the insulation packages 12 as well as insulation package ends 36 and 38. In other words, covering the first film ends 28, 30 with the second film 34 may block or reduce the ability of a user to grab and/or place force on the first film ends 28, 30 in axial directions 18 and 32.

The second film 34 may be a stretch film made out of polyethylene, co-extruded polyethylene, etc. Stretch film is a film capable of significant stretching (e.g., stretch up to 500% of original dimensions) but returns to its original shape when force is removed. Accordingly, when wrapped around the insulation packages 12 and the first film 16, the second film 34 provides a compressive force as it attempts to return to its original shape. The compressive force of the second film 34 may therefore supplement the compressive force of the first film 16 on the insulation packages 12. In some embodiments, the compressive force of the second film 34 on the insulation packages 12 enables the insulation packaging system 10 to use a thinner first film 16, which may reduce the overall cost of the insulation packaging system 10.

In some embodiments, the second film 34 may include one or more cabled or roped portions 40, 44 that facilitate handling/maneuvering of the unit 14. For example, the second film 34 may include a first roped portion 40 at a film end 42 and/or a second roped portion 44 at an opposing film end 46. The roped portions 40 and 44 may be formed by repeatedly overlapping first and second ends 42 and 46 of the second film 34 (e.g., 1, 2, 3, 4, 5, 6, 7, 8, 9, 10 or more times). The thickness of the roped portions 40, 44 may facilitate grabbing of the unit 14 by a user as well as reducing and/or blocking tearing of the second film 34 as the unit 14 is handled during shipping, storage, and on job sites. In some embodiments, after wrapping the second film 34 (e.g., 1, 2, 3, 4, 5, 6, 7, 8, 9, 10 or more times) around the insulation packages 12, the second film 34 may have a combined thickness between 0.5 mil and 6 mil while the roped portions 40 and/or 44 may have a respective combined thickness between 2.0 mil and 15 mil. The roped portions 40 and/or 44 may also have a width 45 between 0.5 mil and 25 mil to facilitate handling.

Figure 2:
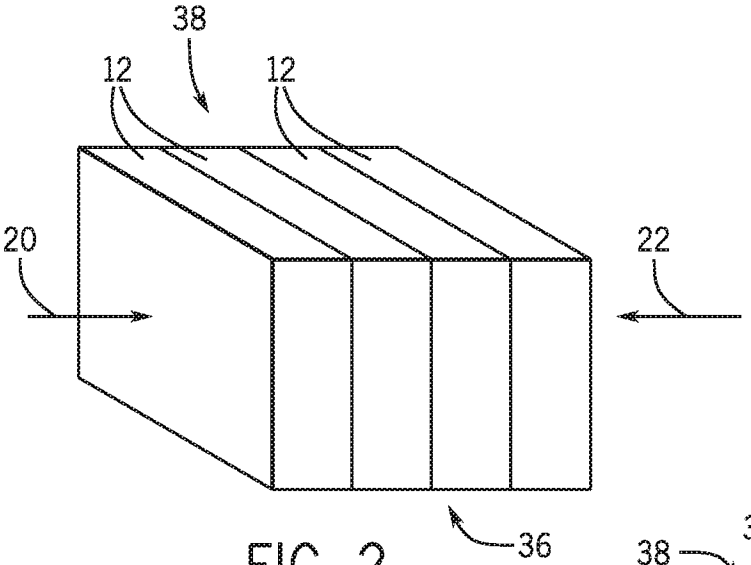
FIG. 2 is a perspective view of multiple insulation packages compressed together.

FIG. 2 is a perspective view of multiple insulation packages 12 compressed together. In FIG. 2, the insulation packages have a rectangular shape, but the insulation packages 12 may have any number of other shapes including cylindrical, square, football shaped, etc. As explained above, the insulation packages 12 are compressed to reduce space, which facilitates shipping and storage. After compressing the insulation packages 12, the insulation packages 12 are wrapped in first and second films 16, 34 to form a unit 14.

Figure 3:
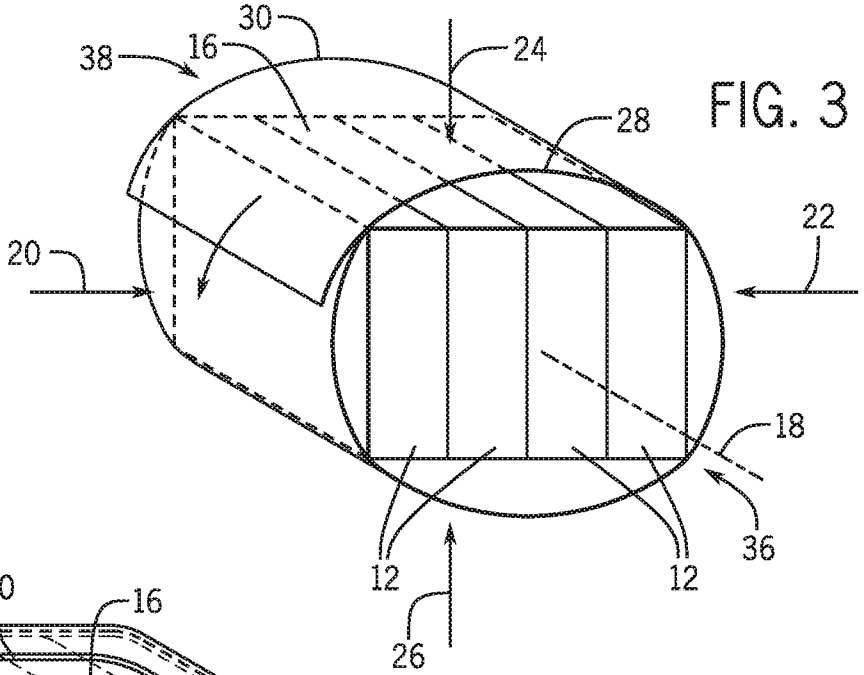
FIG. 3 is a perspective view of multiple insulation packages compressed together and bundled with a first film.

FIG. 3 is a perspective view of multiple insulation packages 12 compressed together and bundled with the first film 16. As explained above, the first film 16 wraps around and compresses the insulation packages 12 in directions 20, 22, 24, and 26. In some embodiments, the first film 16 may be wrapped once around the insulation packages 12. The first film 16 may be an MDO film that stretches less than 10%, 5%, 3%, 2%, or 1% in response to the force from the insulation packages 12. In order to protect the insulation packaging ends 36, 38 and the first film ends 28, 30, a second film 34 is then wrapped around the first film 16.

Figure 4:
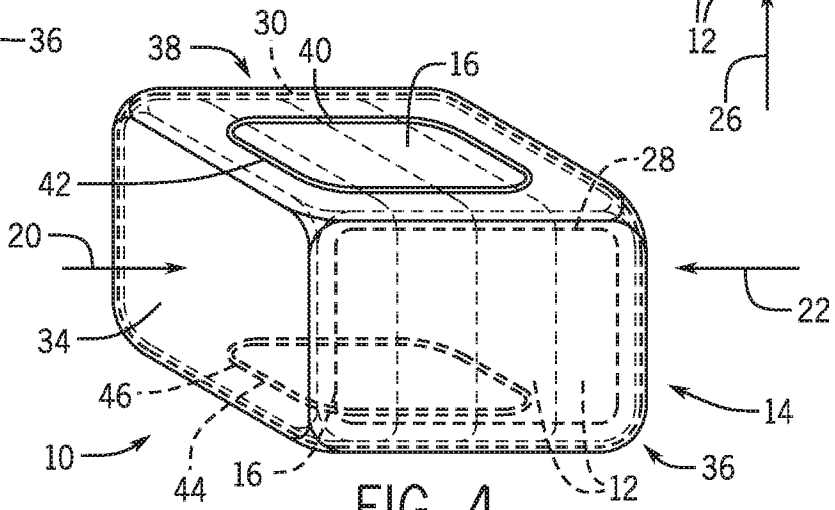
FIG. 4 is a perspective view of multiple insulation packages compressed and bundled together into a unit with a first film and a second film.

FIG. 4 is a perspective view of multiple insulation packages 12 compressed together and bundled with a first film 16 and a second film 34 to form a unit 14. As illustrated, the second film 34 wraps around the insulation packages 12 and the first film ends 28, 30. In this way, the second film 34 protects the first film ends 28, 30 and the insulation package ends 36, 38. Because the second film 34 protects the insulation package ends 36, 38 from water, snow, dirt, etc., the insulation packages 12 may use a sleeve packaging (i.e., open-ended packaging) to package the insulation, which may reduce the overall cost and complexity of the unit 14.

As explained above, the second film 34 may be a stretch film capable of significant stretching (e.g., stretch up to 500% of original dimensions). When wrapped around the insulation packages 12 and the first film 16, the second film 34 provides a compressive force on the insulation packages 12 and first film 16. The compressive force of the second film 34 may supplement the compressive force of the first film 16 on the insulation packages 12. In some embodiments, the second film 34 may include one or more cabled or roped portions 40, 44 that facilitate handling/maneuvering of the unit 14. For example, the second film 34 may include a first roped portion 40 at a first end 42 and/or a second roped portion 44 at a second end 46. The thickness of the roped portions 40, 44 facilitates handling of the unit 14 while reducing and/or blocking tearing of the second film 34 during shipping, storage, and handling on job sites.

Figure 5:
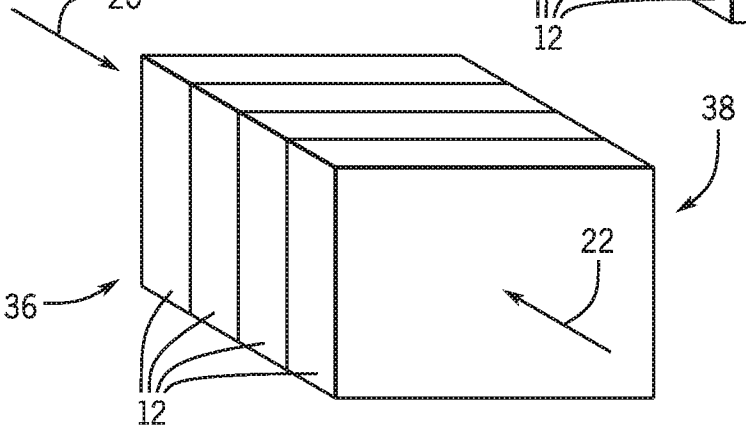
FIG. 5 is a perspective view of multiple insulation packages compressed together.

FIG. 5 is a perspective view of multiple insulation packages 12 compressed together. In FIG. 5 the insulation packages have a rectangular shape, but the insulation packages 12 may have any number of other shapes including cylindrical, square, football shaped, etc. As explained above, the insulation packages 12 are compressed to reduce space, which facilitates shipping and storage. After compressing the insulation packages 12, the insulation packages 12 are inserted into a bag 60 made from a first film.

Figure 6:
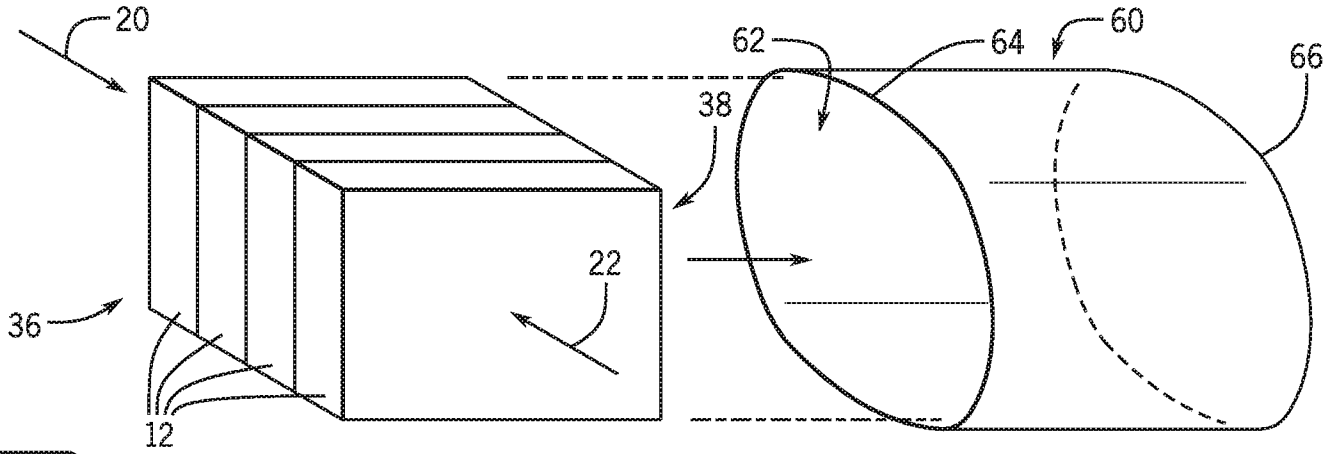
FIG. 6 is a perspective view of multiple insulation packages compressed together within a bag made from a first film.

FIG. 6 is a perspective view of multiple insulation packages 12 compressed together within the bag 60. As illustrated, the bag 60 defines an aperture 62 capable of receiving the compressed insulation packages 12. After placing the insulation packages 12 in the bag 60, the bag 60 maintains the insulation packages in a compressed state. The bag 60 may be a woven film made out of polyethylene, polypropylene, etc. Similar to MDO film, woven film may stretch less than 10%, 5%, 3%, 2%, or 1% in response to the force of the insulation packages 12. As illustrated, the bag 60 may expose one of the insulation package ends 36, 38. In order to protect the end 36 or 38 from water, snow, dirt, etc. a second film 34 is wrapped around the bag 60.

Figure 7:
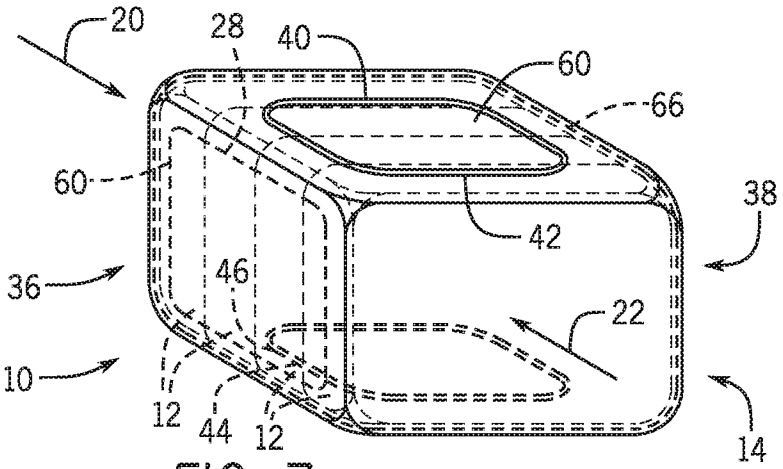
FIG. 7 is a perspective view of multiple insulation packages compressed and bundled together into a unit with a first film and a second film.

FIG. 7 is a perspective view of multiple insulation packages 12 compressed together and bundled into a unit 14 with the bag 60 (e.g., first film bag) and the second film 34. As illustrated, the second film 34 wraps around the insulation packages 12 and bag ends 64, 66 of the bag 60. In this way, the second film 34 protects the open bag end 64 and insulation package end 36 or 38. Because the bag 60 and second film 34 protect the insulation package ends 36, 38 from water, snow, dirt, etc., the insulation packages 12 may use a sleeve packaging (i.e., open ended packaging) to package the insulation, thus potentially reducing the overall cost and complexity of the unit 14.

As explained above, the second film 34 may be a stretch film capable of significant stretching (e.g., stretch up to 500% of original dimensions). When wrapped around the insulation packages 12 and the bag 60, the second film 34 may supplement the compressive force of the bag 60. Furthermore, the second film 34 may include one or more cabled or roped portions 40, 44 that facilitate handling/maneuvering of the unit 14. For example, the second film 34 may include a first roped portion 40 at a first end 42 and/or a second roped portion 44 at a second end 46 of the second film 34. The thickness of the roped portions 40, 44 reduces and/or blocks tearing of the second film 34 as the unit 14 is handled during shipping, storage, and on job sites. For example, the second film 34 may have a combined thickness of 0.5 mil to 6 mil while the roped portions 40 and/or 44 may have a respective combined thickness of 0.5 mil to 25 mil. In some embodiments, the second film 34 may be wrapped 1, 2, 3, 4, 5, 6, 7, 8, 9, 10 or more times around the insulation packages 12 and bag 60.

Figure 8:
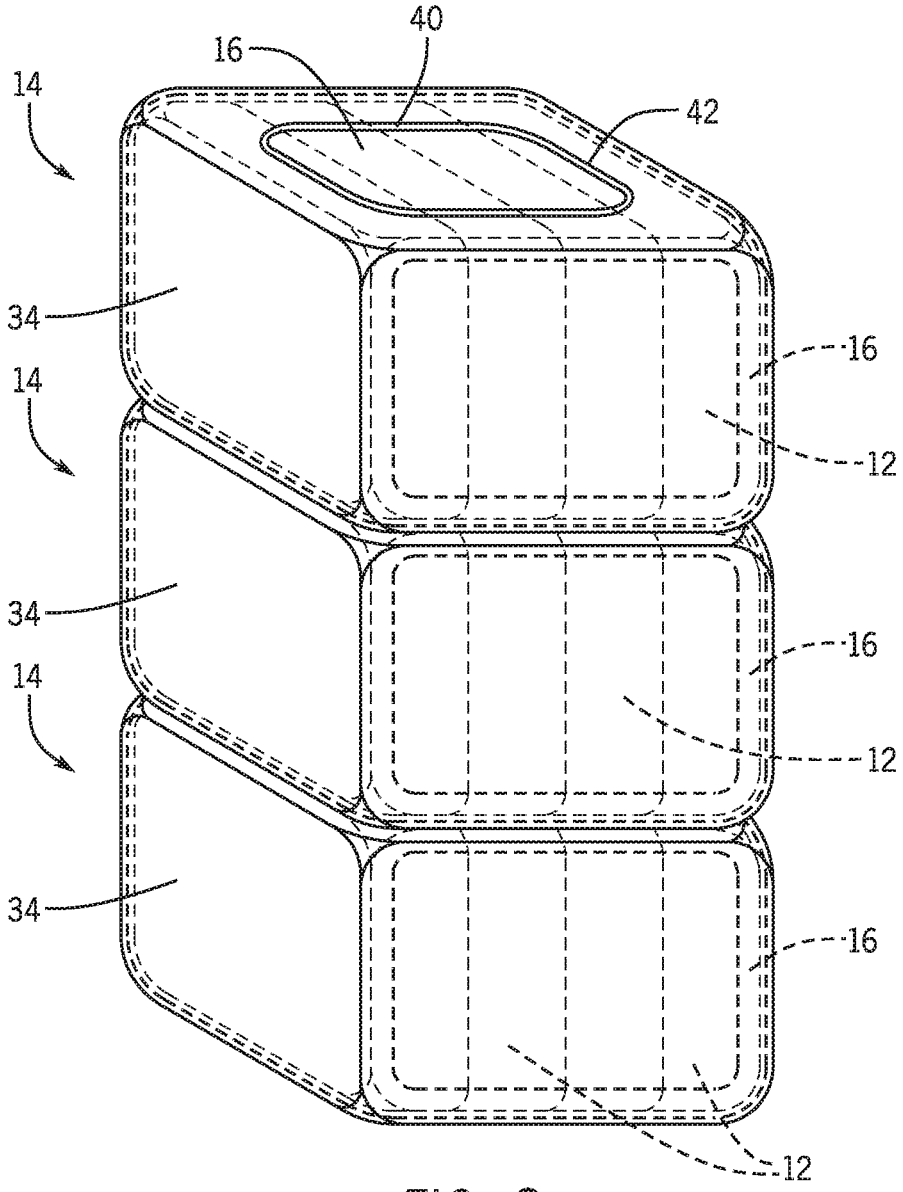
FIG. 8 is a perspective view of multiple units stacked on top of each other.

FIG. 8 is a perspective view of multiple units 14 stacked on top of each other. In some embodiments, the second film 34 may have a coefficient of friction greater than the coefficient of friction of the first film 16 or bag 60. For example, the second film 34 may have a coefficient of friction greater than 0.20, while the first film 16 or bag 60 may have a coefficient of friction less than 0.70. Accordingly, because the second film 34 wraps around the first film 16 or the bag 60, the second film 34 may reduce or block sliding, shifting, etc. of the units 14 during shipping and storage operations.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method of packaging insulation, comprising:

compressing a plurality of insulation packages together, the plurality of insulation packages comprise first ends and second ends, wherein the plurality of insulation packages define an axis and a plurality of edges on opposing sides of the plurality of insulation packages;

wrapping a first film around the axis to couple the plurality of insulation packages together, the first film defining edges on opposing sides of the first film when the plurality of insulation packages together are coupled via the first film; and wrapping a second film around the first and second ends of the plurality of insulation packages, wherein:

the second film covers the edges on the opposing sides of the first film and covers the first ends, the second ends, and each edge defined by the plurality of insulation packages such that the plurality of insulation packages are entirely covered by the first film and the second film;

the first film and second film are formed of different materials; and the first film stretches less than 10% of its original dimension in response to a force exerted by the plurality of insulation packages.

2. The method of claim 1, wherein wrapping the first film around the axis, comprises wrapping the first film one time around the axis of the plurality of insulation packages.

3. The method of claim 1, wherein wrapping the second film around the plurality of insulation packages, comprises wrapping the second film at least two times around the plurality of insulation packages.

4. The method of claim 1, wherein the first film comprises a machine direction orientation film and the second film comprises a stretch film.

5. The method of claim 4, wherein the second film is elastically stretchable up to 500% of an original dimension.

6. The method of claim 5, wherein the second film is elastically stretchable up to 500% of an original dimension but is able to return to its original shape when force is removed.

7. The method of claim 1, comprising overlapping a first end of the second film to form a first roped portion.

8. The method of claim 7, comprising overlapping a second end of the second film to form a second roped portion.

9. The method of claim 8, wherein each of the first roped portion and the second roped portion is configured to overlay one of opposing top and bottom sides defined by the first film.

10. The method of claim 7, wherein the roped portion includes a plurality of layers of the material of the second film.

11. A method of packaging insulation, comprising:

compressing a plurality of insulation packages together, the plurality of insulation packages comprise first ends and second ends, wherein the plurality of insulation packages define an axis and a plurality of edges on opposing sides of the plurality of insulation packages;

wrapping a first film around the axis to couple the plurality of insulation packages together; and wrapping a second film around the first and second ends of the plurality of insulation packages, wherein:

the second film covers the first ends, the second ends, and each edge of the plurality of edges defined by the plurality of insulation packages;

the first film stretches less than 10% of its original dimension in response to a force exerted by the plurality of insulation packages; and the second film is elastically stretchable up to 500% of an original dimension but is able to return to its original shape when force is removed.

12. The method of claim 11, wherein the second film has a greater coefficient of friction than the first film.

13. A method of packaging insulation, comprising:

compressing a plurality of insulation packages together, the plurality of insulation packages comprise first ends and second ends, wherein the plurality of insulation packages define an axis;

wrapping a first film around the axis to couple the plurality of insulation packages together; and wrapping a second film around the first and second ends of the plurality of insulation packages, wherein:

the first film directly contacts each surface of the plurality of insulation packages around the axis defined by the plurality of insulation packages;

the first film and second film are formed of different materials;

the first film stretches less than 10% of its original dimension in response to a force exerted by the plurality of insulation packages.

* * * * *